US005584161A

United States Patent [19]

Zanini et al.

[11] Patent Number: 5,584,161

[45] Date of Patent: Dec. 17, 1996

[54] CAPPING UNIT FOR AUTOMATICALLY ASSEMBLING PUMP-OPERATED SPRAY CAP BOTTLES

[75] Inventors: Gianpietro Zanini, Montanara; Renzo Vesentini; Carlo Corniani, both of Marmirolo, all of Italy

[73] Assignee: Azionaria Costruzioni Macchine Automatiche A.C.M.A. S.p.A., Bologna, Italy

[21] Appl. No.: 494,693

[22] Filed: Jun. 26, 1995

[30] Foreign Application Priority Data

Jun. 27, 1994 [IT] Italy ..... BO94A0294

[51] Int. Cl.[6] ..... B65B 7/28; B67C 7/00

[52] U.S. Cl. ..... 53/317; 53/331.5

[58] Field of Search ..... 53/317, 331.5, 53/490, 306, 350, 365, 367, 287

[56] References Cited

U.S. PATENT DOCUMENTS

| | | | |
|---|---|---|---|
| 4,232,499 | 11/1980 | Holstein | 53/331.5 |
| 4,277,929 | 7/1981 | Schindel | 53/331.5 |
| 5,207,048 | 5/1993 | Wysocki | 53/331.5 X |
| 5,467,527 | 11/1995 | Zanini et al. | 53/331.5 X |
| 5,479,762 | 1/1996 | Bliss | 53/317 X |

FOREIGN PATENT DOCUMENTS

| | | |
|---|---|---|
| 630331 | 10/1992 | Australia . |
| 0559946 | 9/1993 | European Pat. Off. . |

*Primary Examiner*—James F. Coan

*Attorney, Agent, or Firm*—Oblon, Spivak, McClelland, Maier & Neustadt, P.C.

[57] ABSTRACT

A capping unit for capping containers with respective caps, each presenting a spray head with a ring nut for fitting it to the threaded neck of the container; the capping unit presenting at least one capping head wherein a first gripping device grips a respective spray head, and a second gripping device presents two jaws for gripping the ring nut and rotating it in relation to the first gripping device; each jaw presenting a gripping roller integral with a respective planetary gear of an epicyclic drive wherein each planetary gear is barrel-shaped and presents teeth in turn presenting a convex longitudinal profile and meshing permanently with a straight-toothed outer ring gear regardless of the position of the relative jaw.

9 Claims, 9 Drawing Sheets

CAPPING UNIT FOR AUTOMATICALLY ASSEMBLING PUMP-OPERATED SPRAY CAP BOTTLES

BACKGROUND OF THE INVENTION

The present invention relates to a capping unit for automatically assembling pump-operated spray cap bottles.

Here and hereinafter, the term "pump-operated spray cap bottle" is intended to mean a bottle comprising a container with an externally threaded neck; and a cap defined by an internally threaded cup-shaped ring nut connected releasably to the threaded neck of the container and in rotary and axially fixed manner to a pump-operated spray head.

More specifically, the present invention relates to a particularly straightforward, reliable capping unit for automatically assembling pump-operated spray cap bottles wherein the spray head is substantially L-shaped, extends over and projects laterally outwards of the ring nut, and presents a trigger extending downwards from the spray head and to the side of the ring nut.

SUMMARY OF THE INVENTION

According to the present invention, there is provided a capping unit for automatically assembling pump-operated spray cap bottles comprising a container with an externally threaded neck, and a cap presenting both a pump-operated spray head and an internally threaded ring nut mounted for rotation on the spray head; the capping unit presenting at least one capping assembly comprising a capping head; the capping head comprising a first gripping device movable into a closed position to grip a respective said spray head, and a second gripping device presenting two jaws movable into a closed position to grip the ring nut; and the capping assembly comprising first actuating means for moving the first gripping device to and from the closed position, second actuating means for moving the second gripping device to and from the closed position, third actuating means for rotating the ring nut in relation to the first gripping device, and fourth actuating means for moving the capping head to and from a position wherein said cap is connected to the relative said container; characterized in that said second gripping device comprises, for each jaw, a gripping roller forming the end portion of the jaw; said second actuating means being connected to each jaw for moving it to and from the relative said closed position wherein the relative gripping roller contacts said ring nut; and said third actuating means being connected to each said gripping roller to rotate it about a first axis, and comprising a drive in turn comprising a ring gear presenting a second axis and rotating about the second axis in relation to the first gripping device, and, for each gripping roller, a planetary gear coaxial with the respective first axis and integral with the relative gripping roller.

The drive of the above capping unit preferably also comprises a carrier coaxial with and fixed in relation to the second axis; each planetary gear being supported on said carrier.

Each said jaw is also preferably supported on said carrier so as to rotate, in relation to the carrier, about a third axis to and from said closed position; the third axis being perpendicular to the plane defined by the other two axes; and each planetary gear being movable with the relative jaw about the third axis, being barrel-shaped, and presenting teeth in turn presenting a convex longitudinal profile and meshing permanently with the outer ring gear regardless of the orientation of the relative said first axis about the relative said third axis and in relation to the second axis.

According to a preferred embodiment of the present invention, the above capping unit also comprises a carousel conveyor rotating about a fourth axis parallel to the second axis, and in turn comprising a central drum with at least one seat for supporting and guiding a relative said container about the fourth axis; said capping assembly being supported on the drum coaxially with said seat, so as to rotate with the drum about the fourth axis.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
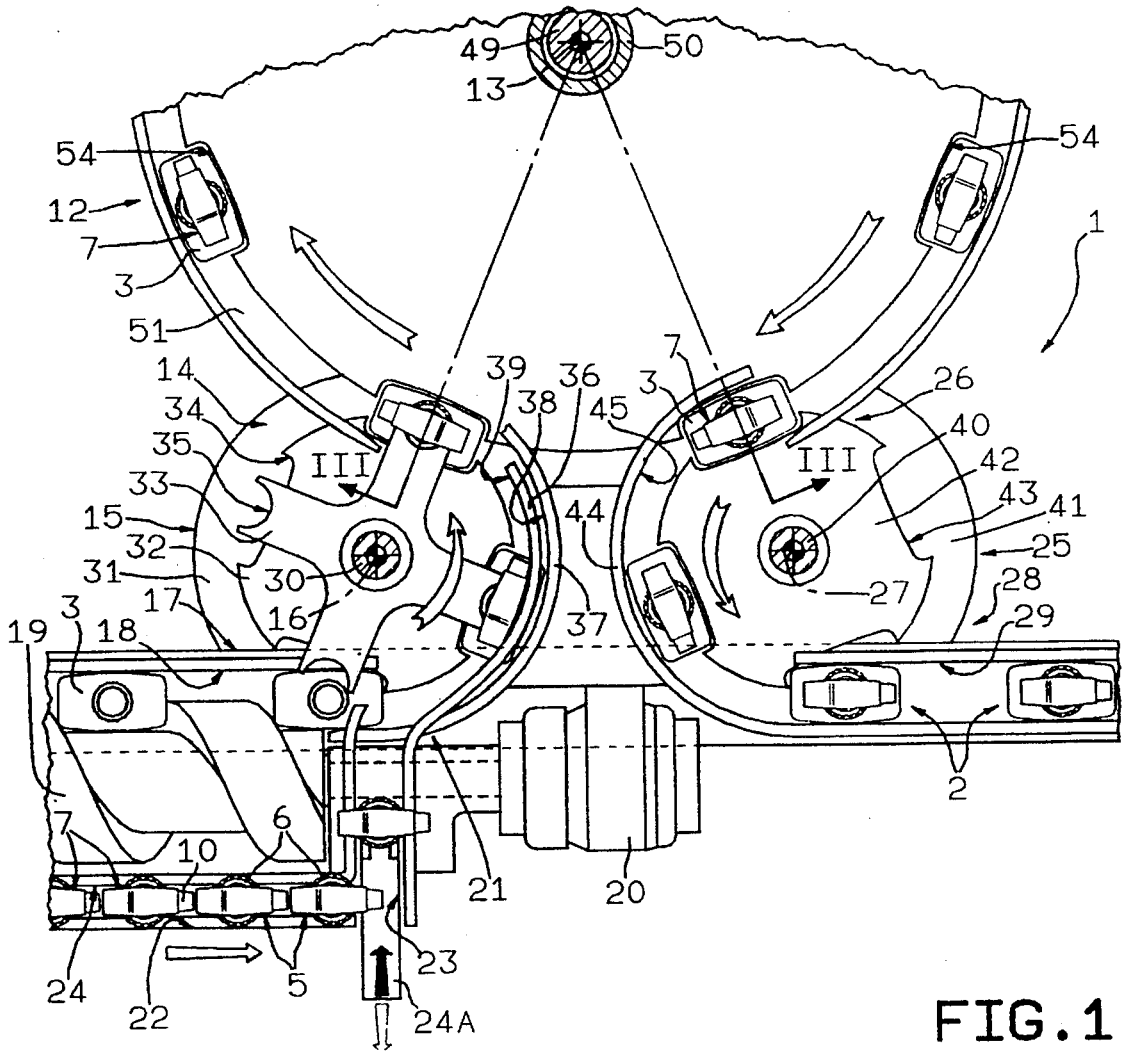
FIG. 1 shows a partial schematic plan view of a preferred embodiment of the capping unit according to the present invention.

Number 1 in FIG. 1 indicates a capping unit for pump-operated spray cap bottles 2.

Figure 2:
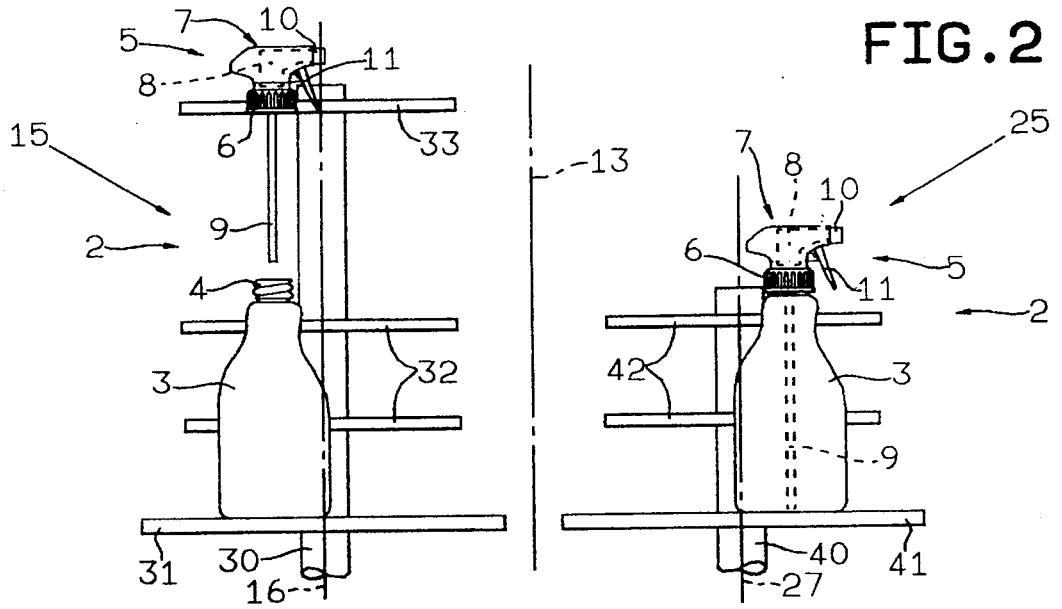
FIG. 2 shows a side view of a FIG. 1 detail in two different operating positions.

As shown in FIG. 2, each bottle 2 comprises a container 3 with an externally threaded neck 4; and a cap 5 in turn comprising a cup-shaped ring nut 6. Ring nut 6 is threaded internally for releasable connection to neck 4 of container 3, and is connected in rotary and axially fixed manner to a pump-operated, substantially L-shaped spray head 7 extending over and laterally outwards of ring nut 6. Spray head 7 comprises a pump body 8 housed inside spray head 7 and presenting, on one side, a suction tube 9 extending inside container 3, and, on the other side, a nozzle 10 projecting radially outwards from spray head 7, presenting an ejector (not shown), and connected to a piston (not shown) operated manually by a trigger 11 extending from spray head 7 towards container 3 and to the side of ring nut 6.

With reference to FIG. 1, unit 1 comprises a main carousel conveyor 12 mounted to rotate clockwise (in FIG. 1) about a vertical axis 13, and which, at a first transfer station 14, is supplied by a rotary input conveyor 15 with a succession of containers 3 and a separate succession of caps 5. Conveyor 15 rotates anticlockwise (in FIG. 1) about an axis 16 parallel to axis 13, and is supplied at a first input station 17 with a succession of containers 3 from a horizontal input channel 18 presenting a screw feeder 19 driven by a motor 20 and which provides for feeding containers 3 in steps to station 17. Conveyor 15 is also supplied at a second input station 21 with a succession of caps 5 by a horizontal, substantially L-shaped conveyor 22 presenting an output portion 23 perpendicular to channel 18, and an input portion 24 parallel to channel 18. Along portion 24, caps 5 are advanced successively in close contact with one another-and with respective spray heads 7 parallel to channel 18; whereas, along portion 23, caps 5 are advanced by a push arm 24*a* which is moved back and forth along portion 23 between a pickup position wherein caps 5 from portion 24 are picked up, and a release position wherein caps 5 are fed to station 21 in time with containers 3. Arm 24*a* is also so formed as to ensure spray heads 7 are maintained in the same position along portion 23.

Conveyor 12 provides for assembling caps 5 on to respective containers 3, and feeding the assembled bottles 2 to a rotary output conveyor 25 via a second transfer station 26. Conveyor 25 rotates anticlockwise (in FIG. 1) about an axis 27 parallel to axis 13, to transfer bottles 2 from station 26 to an output station 28 and into an output channel 29 aligned with channel 18.

Figure 3:
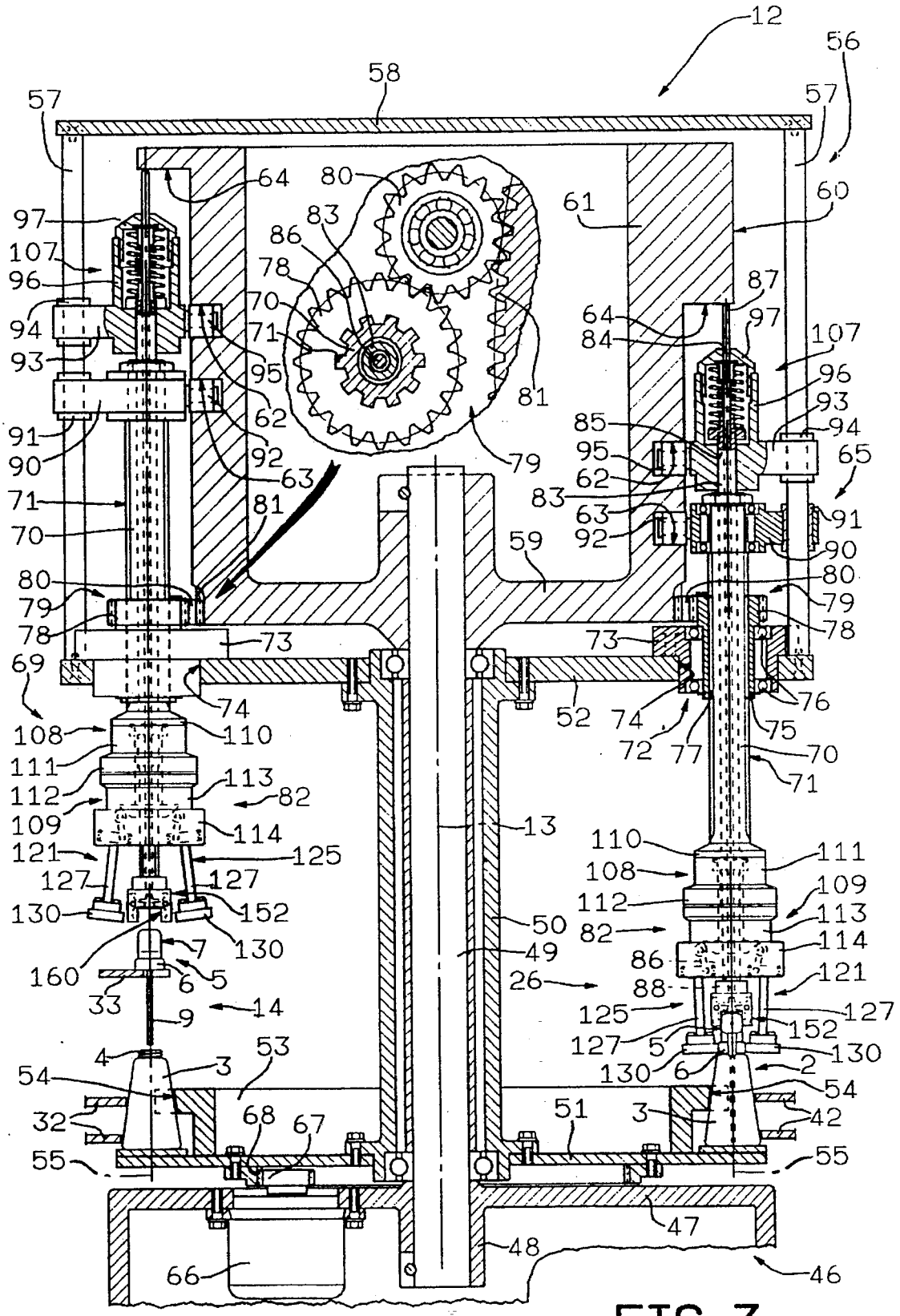
FIG. 3 shows a larger-scale section along line III—III in FIG. 1.

With reference to FIGS. 1 and 3, conveyor 15 comprises a shaft 30 coaxial with axis 16 and fitted with a bottom platform 31, a pair of intermediate disks 32 and an upper cross 33. Disks 32 present an orderly succession of peripheral seats 34 for partially receiving respective containers 3 supported on platform 31; while cross 33 presents an orderly succession of seats 35 aligned, in a direction parallel to axis 16, with respective seats 34, and each receiving the spray head 7 of a respective cap 5 positioned with ring nut 6 resting on cross 33. Conveyor 15 also comprises two outer guides 36 and 37 cooperating, in use, with disks 32 and cross 33, for retaining containers 3 and caps 5 inside respective seats 34 and 35, and for feeding them along respective curved channels 38 and 39 extending about axis 16 between stations 17 and 21 on one side and stations 21 and 14 on the other.

Like conveyor 15, conveyor 25 comprises a shaft 40 coaxial with axis 27 and fitted with a bottom platform 41, and a pair of top disks 42 with an orderly succession of peripheral seats 43 for partially receiving respective bottles 2 resting on platform 41. Conveyor 25 also comprises an outer guide 44 defining, with the outer periphery of disks 42, a channel 45 for feeding bottles 2 from station 26 to station 28.

With reference to FIG. 3, carousel conveyor 12 comprises a base 46, the substantially horizontal top wall 47 of which presents a tubular appendix 48 coaxial with axis 13 and engaged by a fixed shaft 49 extending upwards from base 46 and supporting for rotation, via the interposition of bearings, a tubular body 50 presenting a circular bottom flange 51 and a circular top flange 52. Flange 51 constitutes a supporting platform for containers 3, and is fitted on its top surface with a disk 53 coaxial with axis 13 and presenting a succession of peripheral seats 54 similar to seats 34, and the respective axes 55 of which are parallel to and arranged about axis 13 with the same spacing as seats 34.

Flange 52 constitutes the bottom wall of a cylindrical housing 56 comprising a cylindrical lateral cage defined by a number of rods 57 equally spaced about axis 13 with the same spacing as seats 54, and extending upwards from the outer periphery of flange 52; and a top wall 58 integral with the top end of rods 57 and parallel to flange 52. The top end of shaft 49 projects inside housing 56 and is fitted to the bottom wall 59 of a drum cam 60 housed in a fixed position inside housing 56 and presenting a lateral wall 61 in which are formed two annular cam grooves 62 and 63 arranged side by side along axis 13, and an annular cam shoulder 64 over grooves 62 and 63 and facing flange 52.

Tubular body 50, flanges 51 and 52, disk 53 and housing 56 constitute a drum 65 mounted for rotation on shaft 49 and rotated clockwise (in FIG. 1) about axis 13 by a motor 66, the output shaft of which extends through wall 47 of base 46 and is fitted with an output pinion 67 meshing with an internally toothed ring gear 68 integral with the bottom surface of flange 51 and coaxial with axis 13.

Each seat 54 is associated with a respective capping assembly 69 coaxial with respective axis 55, supported on cam 60, and connected to drum 65 so as to rotate with it about axis 13 and move axially in relation to it along axis 55.

As assemblies 69 are identical, only one will be detailed in the following description which obviously also applies to each of assemblies 69 fitted to cam 60.

Figure 4:
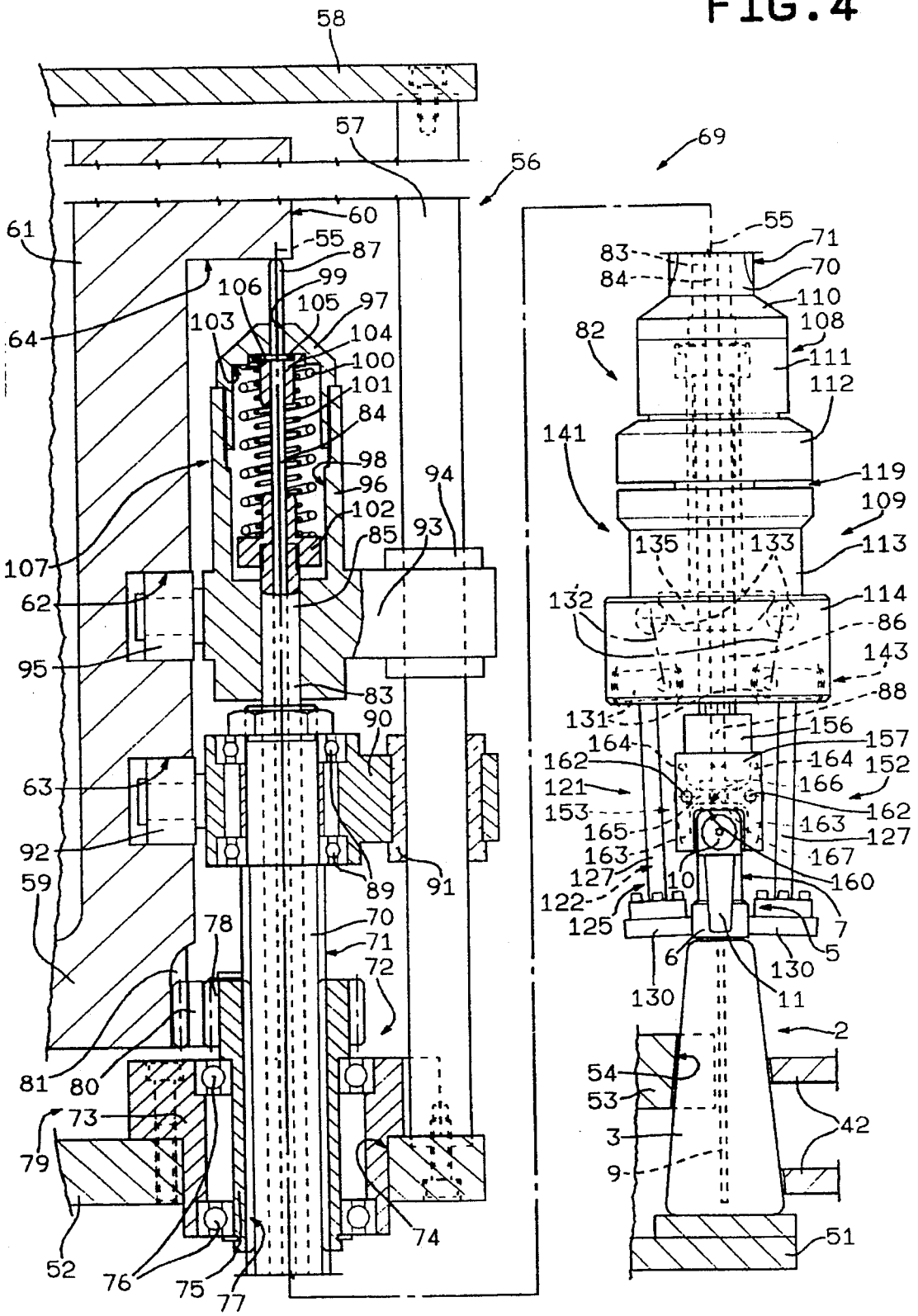
FIG. 4 shows a larger-scale view, with parts removed for clarity, of a detail in FIG. 3.
Figure 5:
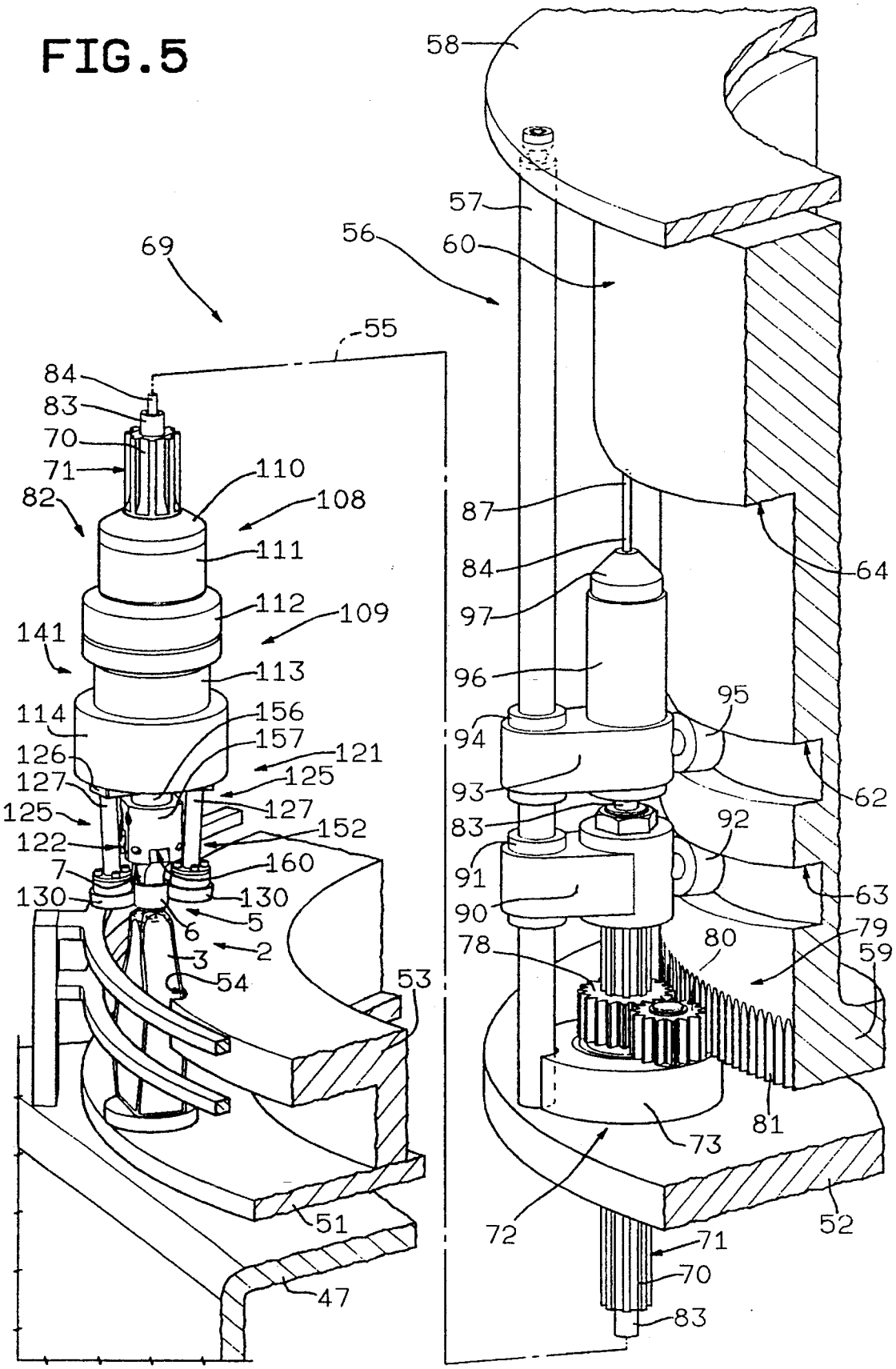
FIG. 5 shows a view in perspective of the FIG. 4 detail in a different operating position.

With reference to FIG. 3 and particularly FIG. 4, assembly 69 comprises a tubular guide shaft 70 presenting a splined outer profile 71 along its full length, and extending coaxially with axis 55 and in rotary and axially sliding manner through a guide assembly 72 integral with drum 65 and supported on flange 52. Assembly 72 in turn comprises a bush 73 coaxial with axis 55 and force fitted inside a hole 74 formed in flange 52. Bush 73 is locked angularly in relation to flange 52 by a respective rod 57, and is fitted through with a sleeve 75 connected in rotary manner to bush 73 via the interposition of a pair of bearings 76, and internally connected in axially sliding manner to shaft 70 by means of a splined inner profile 77 complementary to profile 71.

A top end portion of sleeve 75 projects outwards of bush 73 into housing 56, and is fitted with a pinion 78 forming part of a drive 79 for rotating all of shafts 70 about respective axes 55. For each assembly 69, drive 79 comprises an idle gear 80 integral with guide assembly 72 and meshing not only with a respective pinion 78 but also with a ring gear 81 forming part of drive 79 and formed on the outer surface of wall 61 of cam 60 beneath grooves 62 and 63.

In addition to shaft 70 and guide assembly 72, assembly 69 also comprises a capping head 82 fitted to the bottom end of shaft 70 so as to move with shaft 70 between flanges 51 and 52, and controlled by a tubular shaft 83 and by a rod 84 coaxial with axis 55 and shaft 83. Shaft 83 is fitted in sliding manner inside shaft 70, and presents a top end portion 85 projecting upwards from the top end of shaft 70, and a bottom end portion 86 (FIGS. 8 and 9) engaged inside head 82. Control rod 84 is fitted in sliding manner inside shaft 83, and presents a top end portion 87 projecting upwards from the top end portion 85 of shaft 83 and which engages shoulder 64 to move rod 84 axially in relation to drum 65. Rod 84 also presents a bottom end portion 88 (FIGS. 8 and 9) projecting downwards from the bottom end portion 86 of shaft 83 and extending axially inside head 82.

Shaft 70 extends inside housing 56 through assembly 72, and is fitted in rotary and axially fixed manner, via the interposition of a pair of bearings 89, with a sleeve 90 presenting two diametrically opposed appendixes fitted respectively with a bush 91 parallel to axis 55, and with a roller 92. Bush 91 is a guide bush engaging in sliding manner a respective rod 57; and roller 92 is a tappet roller which engages groove 63 to axially connect capping head 82 to cam 60 and move shaft 70 axially in relation to cam 60 and flange 51. The top end portion 85 of shaft 83 extends in angularly fixed and limited sliding manner through a sleeve 93 which presents two diametrically opposed appendixes respectively fitted with a bush 94 coaxial with bush 91, and with a roller 95. Sleeve 93 also presents a tubular appendix 96 extending upwards from sleeve 93 and coaxially with axis 55 to form, together with a cap 97 fitted to appendix 96, a substantially cylindrical chamber 98 coaxial with axis 55. Bush 94 acts both as a guide bush engaging in sliding manner a respective rod 57, and as an antirotation bush for maintaining shaft 83 angularly fixed in relation to cam 60; and roller 95 is a tappet roller engaging groove 62 to move shaft 83 axially in relation to cam 60 and shaft 70.

Chamber 98 is fitted through with rod 84 which projects from chamber 98 through a hole 99 formed in cap 97; and chamber 98 is fitted inside with two helical springs 100 and 101 coaxial with axis 55, and of which spring 100 is more rigid than and fitted outside spring 101. Spring 100 is compressed between the flat bottom surface 103 of cap 97, and a ring nut 102 screwed to the top end portion 85 of shaft 83 and fitted through with rod 86; and spring 101 is compressed between ring nut 102 and a bush 104, which is fitted to rod 84, against a ring 105 also fitted to rod 84, and presents a top portion engaged inside a cavity 106 of the same section and formed through flat surface 103. Cap 96, chamber 98, springs 100 and 101, ring nut 102 and bush 104 form an elastic suspension 107, the operation of which is described in detail below.

Figure 8:
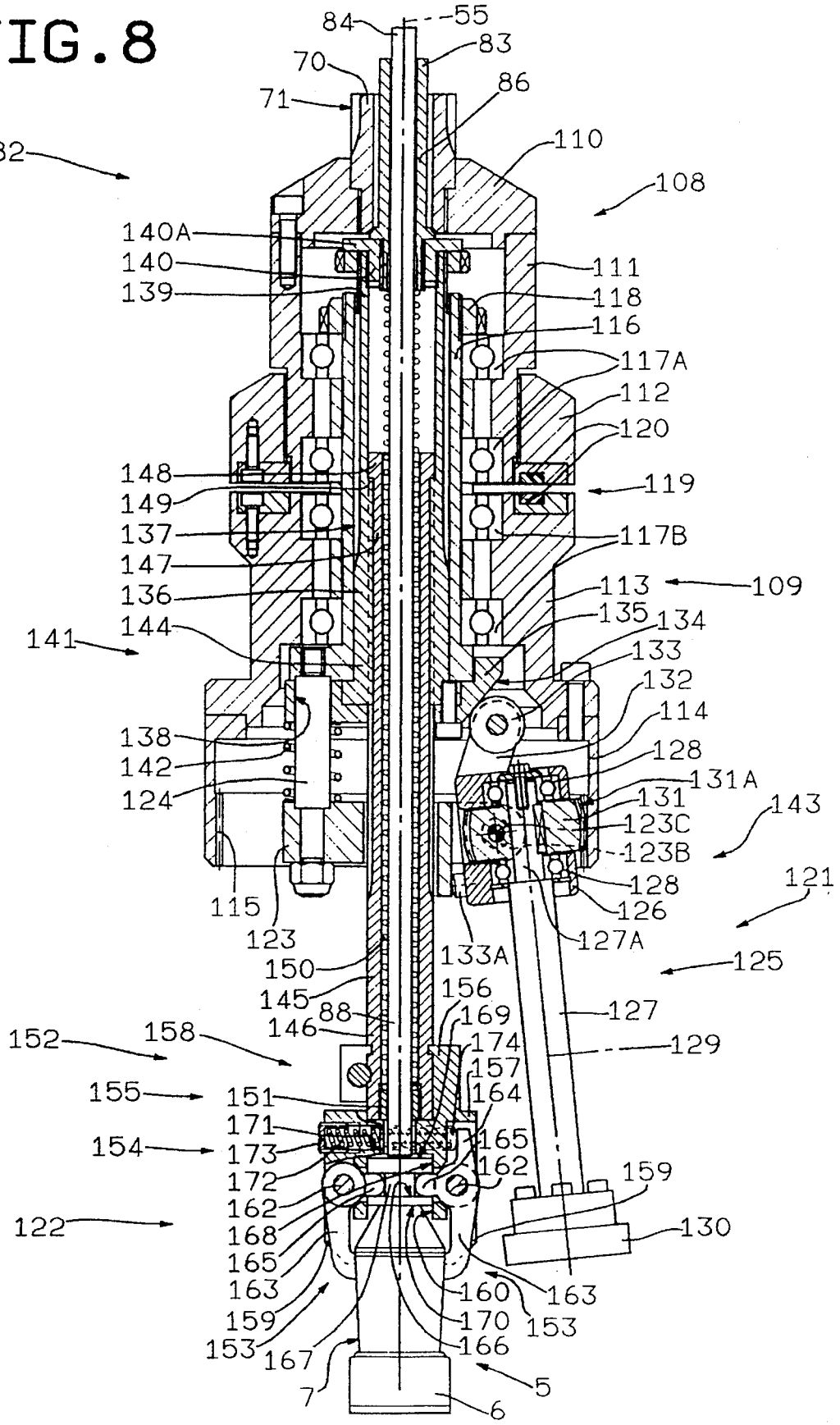
FIGS. 8 and 9 show axial sections of the FIG. 7 detail in two different operating positions.
Figure 9:
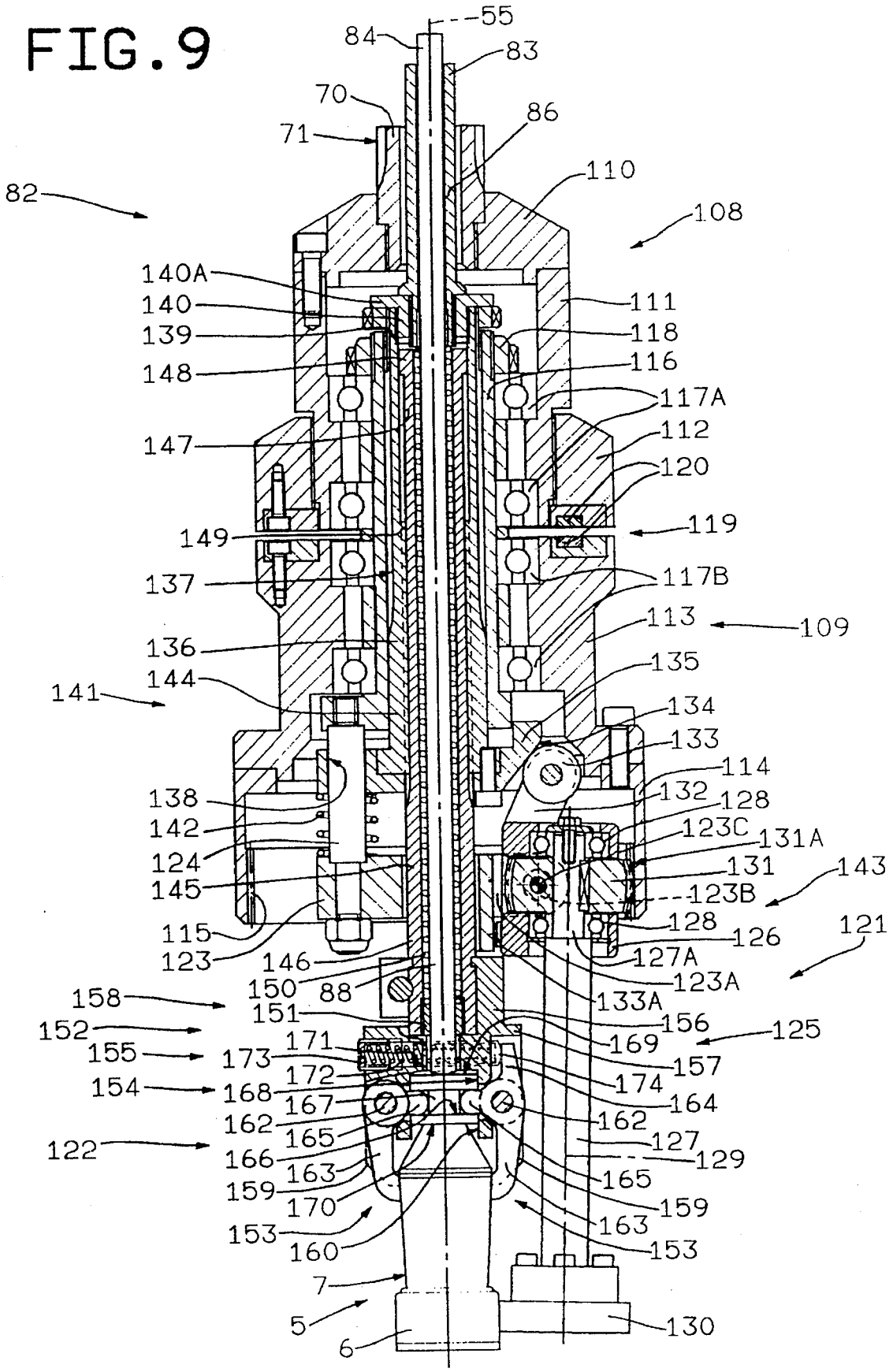
Figure 10:
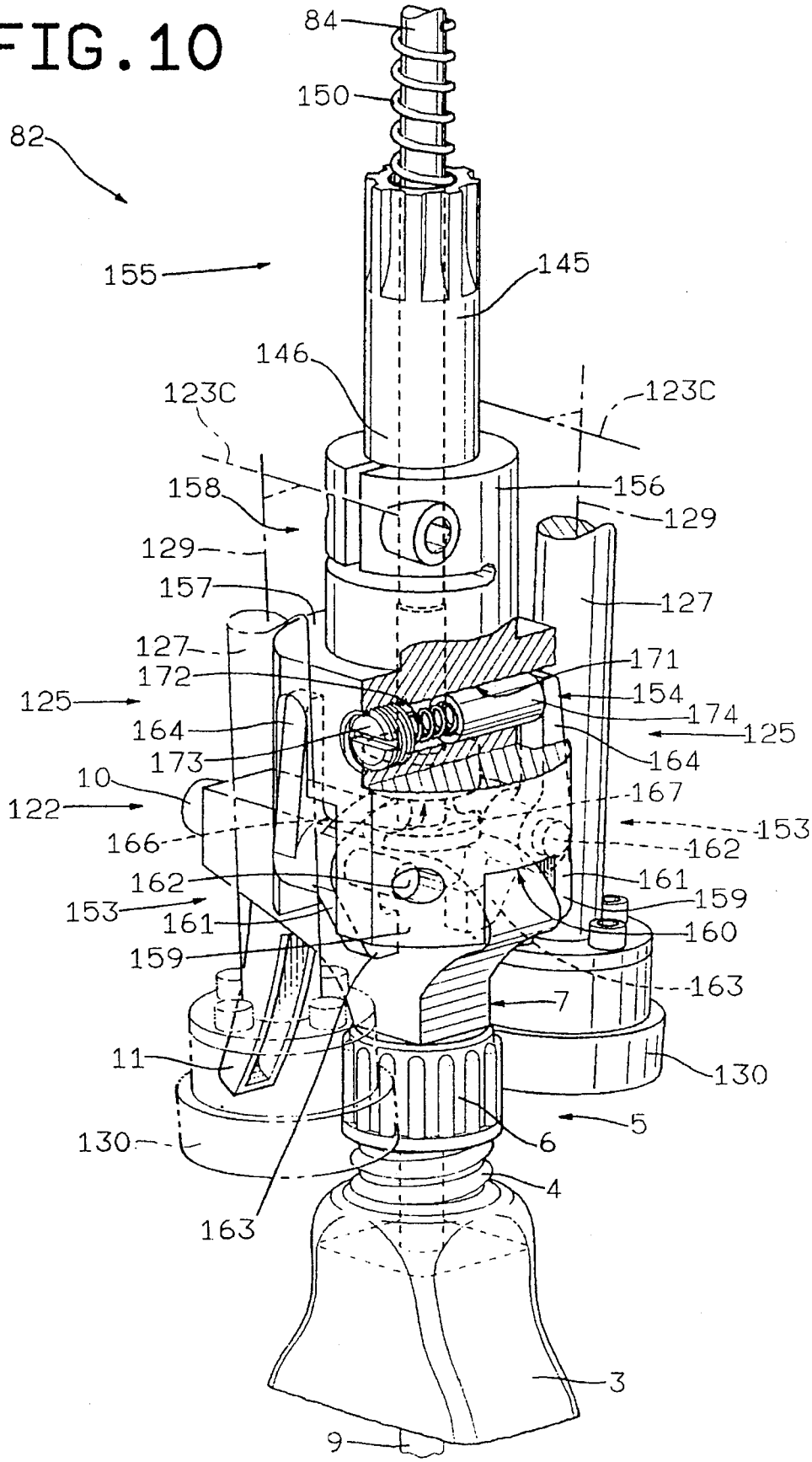
FIG. 10 shows a further view in perspective, with parts in section and parts removed for clarity, of the FIG. 7 detail.

As shown in FIGS. 8 and 9, head 82 comprises an upper cylindrical bell 108 with its concavity facing downwards and coaxial with respective axis 55; and a tubular body 109 coaxial with axis 55 and aligned with bell 108 along axis 55. Bell 108 in turn comprises an upper transverse wall 110 fitted through with and integral with the bottom end of shaft 70; and a cylindrical lateral wall 111, to the bottom end of which is screwed a ring nut 112 coaxial with axis 55. Tubular body 109 comprises a substantially cylindrical lateral wall 113, the bottom end of which is fitted integral with a cup-shaped body 114 coaxial with axis 55 and presenting an internally toothed ring gear 115 on the opposite end to that fitted to wall 113.

Bell 108 and body 109 are made axially integral with each other by a tubular connecting body 116, the top end portion of which, extending inside bell 108, is connected in rotary manner to bell 108 via the interposition of a pair of bearings 117*a*, and the bottom end portion of which, extending inside body 109, is connected in rotary manner to body 109 by a pair of bearings 117*b*. Bearings 117 are locked on to the outer surface of tubular body 116 by a ring nut 118 and via the interposition of spacers.

Bell 108 and tubular body 109 are also connected angularly by means of a torque limiting device 119 presenting permanent coupling magnets 120, one of which, located at the top, is fitted to the bottom end of ring nut 112, the axial position of which in relation to bell 108 and tubular body 109 is adjustable for regulating the maximum torque transmittable by device 119.

Head 82 also comprises a gripping device 121 for engaging portions of ring nut 6 of cap 5 on either side of trigger 11, rotating ring nut 6 about axis 55, and so screwing it on to neck 4 of container 3 to assemble bottle 2; and a further gripping device 122 angularly fixed in relation to conveyor 12, and by which spray head 7 of cap 5 is engaged for maintaining cap 5 in a given angular position in relation to conveyor 12 and container 3.

Figure 7:
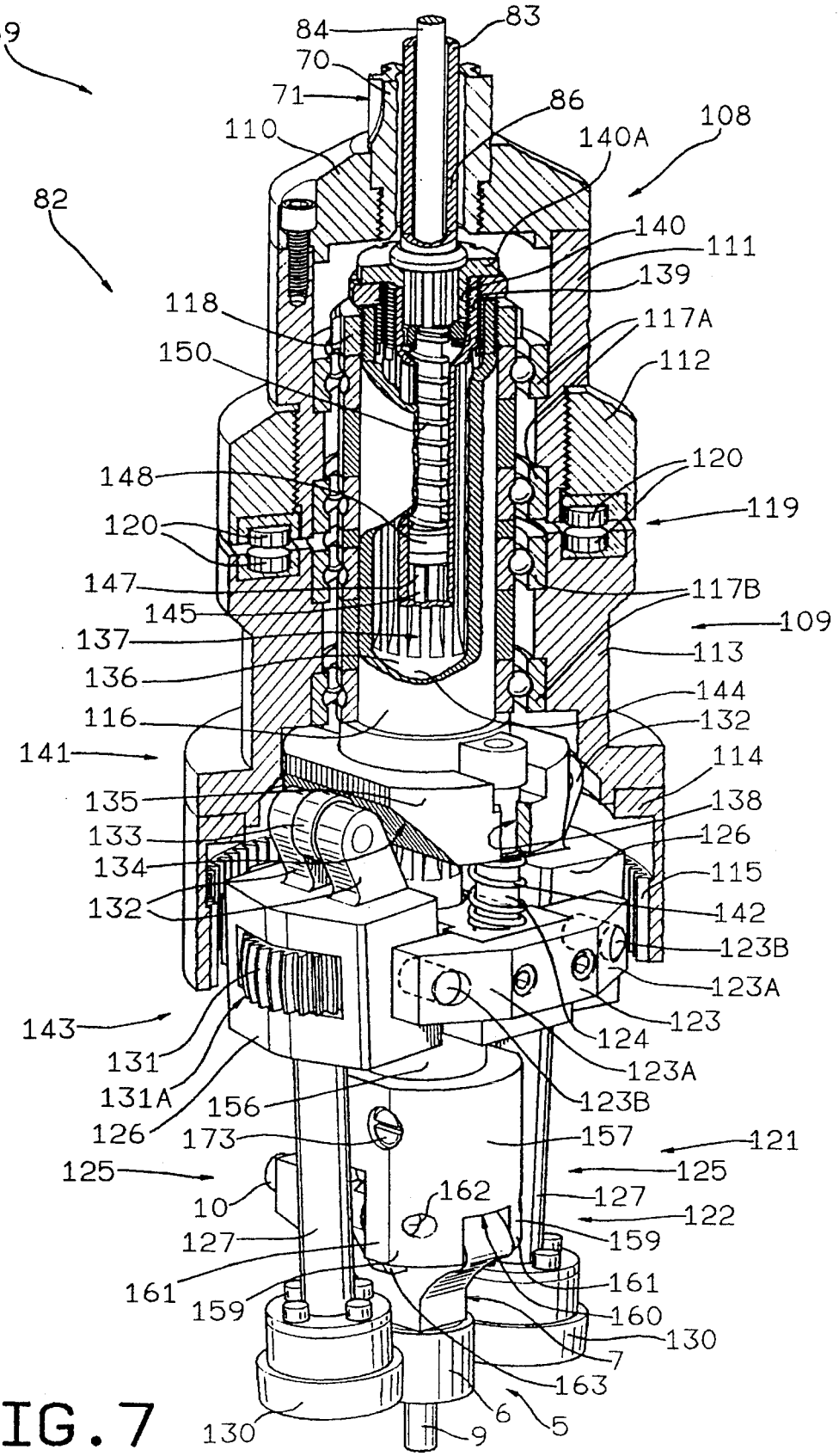
FIG. 7 shows a view in perspective, with parts in section and parts removed for clarity, of a further detail in FIG. 3.

Gripping device 121 comprises a supporting plate 123 with its outer periphery facing ring gear 115, and which is made integral with body 116 by a pair of pins 124 (only one shown) extending from body 116 parallel to and in diametrically opposed positions in relation to axis 55. Plate 123 is substantially H-shaped, and defines two opposed forks 123*a* (FIG. 7) located on either side of axis 55 and fitted through with respective pins 123*b* presenting axes 123*c* perpendicular to the common plane through axis 55, and each of which defines the pivot of a respective jaw 125 located diametrically opposite the other jaw 125 in relation to axis 55 and angularly offset in relation to pins 124.

Each jaw 125 substantially comprises a rocker arm comprising a substantially prismatic central box 126 from which extend outwards two coaxial pin portions defining a respective pin 123*b*. Each jaw 125 also comprises an arm defined by a shaft 127, an end portion 127a of which extends inside box 126 and is connected in rotary manner to box 126 via the interposition of a pair of bearings 128, so as to rotate about its axis 129 which with axis 55 defines a plane perpendicular to respective axis 123*c*. A further end portion of shaft 127 extends downwards from box 126, and is fitted with an externally knurled roller 130; and portion 127*a* of shaft 127 is fitted with a straight-toothed gear 131 projecting laterally from box 126 and meshing with ring gear 115. As shown in FIG. 8, the teeth of gear 131 present a convex outer longitudinal profile 131*a*, in particular defined by a generating line portion of a spherical ring tangent to the pitch line of ring gear 115 and with its center at the central point of axis 123*c* of respective pin 123*b*.

Finally, each jaw 125 comprises a pair of appendixes 132 extending from the opposite side of box 126 in relation to shaft 127, and defining a fork for supporting a rotary tappet roller 133 which, by means of a spring-loaded pin 133*a* fitted to box 126, is maintained contacting a respective inclined surface 134 formed on the bottom portion of a cam body 135 fitted at the top to a tubular body 136 coaxial with axis 55 and extending inside body 116 to which body 136 is connected in axially sliding and angularly fixed manner by means of a splined joint 137. Body 135 also presents a pair of holes 138 (only one shown) diametrically offset in relation to diametrically opposed surfaces 134, and each of which is engaged in sliding manner by a respective pin 124.

The top end portion 139 of body 136, opposite the portion supporting cam body 135, faces the transverse wall 110 of bell 108, and is closed by a cap 140 fitted through with tubular shaft 83 and connected in axially sliding and angularly fixed manner to the bottom end portion 86 of shaft 83. Cap 140 presents a flange 140*a* designed to contact end portion 86 of shaft 83 for arresting upward axial slide of body 136 in relation to shaft 83.

Body 136 and cam body 135 form a drive 141 which also comprises a pair of helical return springs 142, each fitted on to a respective pin 124. Drive 141 is controlled by shaft 83, and provides for sliding cam body 135 downwards along axis 55 and in opposition to springs 142, so that surfaces 134 act progressively on rollers 133 of jaws 125 which are rotatable about respective pins 123*b* between a closed operating position wherein rollers 130 contact ring nut 6, and an open position. For any position of jaws 125 about respective pins 123*b*, rollers 130 are rotated about respective axes 129 by an epicyclic drive 143 in series with drive 79 and defined by plate 123, which acts as a fixed carrier, by gears 131, which act as planetary gears, and by ring gear 115.

As shown in FIGS. 8 and 9, body 136 presents an internally grooved bottom portion 144 connected in axially sliding and radially fixed manner to a further tubular body 145 coaxial with axis 55 and extending downwards through both body 135 and plate 123, so that a bottom portion 146 projects entirely from head 82. Body 145 slides axially in relation to body 136, but its travel is limited by a projection 148 on the top end 147 of body 145 inside body 136, which projection 148 contacts a shoulder 149 formed inside body 136 at the start of portion 144, to prevent further downward slide of body 145 in relation to body 136.

Body 145 is fitted through, along its full length, with rod 84, which presents an outside diameter smaller than the inside diameter of body 145 which is normally positioned with projection 148 contacting shoulder 149. Rod 84 and body 145 define an annular gap housing a helical spring 150 fitted to rod 84 and compressed between the bottom surface of bottom end portion 86 of shaft 83, and a ring nut 151 screwed inside the bottom end of body 145.

Gripping device 122 is supported on body 145, and comprises a tubular head 152 fitted to the bottom end of body 145 and fitted through with rod 84; and two jaws 153 diametrically opposed in relation to axis 55. Gripping device 122 is normally maintained closed by an elastic reaction device 154; and jaws 153 are moved from a closed operating position to an open position and in opposition to elastic device 154 by a drive 155 also comprising control rod 84 in addition to tubular body 145 and spring 150.

As shown more clearly in FIG. 8, head 152 comprises a tubular top body 156 and a tubular, substantially truncated-cone-shaped bottom body 157 integral and aligned with each other and coaxial with axis 55. Body 156 is fitted to the bottom end of body 145 by a fastening device 158 so that head 152 is angularly fixed in relation to cam 60. From body 157, there extend downwards and parallel to axis 55 two opposed forks 159 located on either side of axis 55 and defining a substantially square-section cavity 160 extending transversely to axis 55 and which, in use, encloses substantially the whole outer surface of spray head 7 of cap 5 to maintain spray head 7 in a fixed angular position in relation to cam 60. Forks 159 each present two arms 161 substantially parallel to each other and to axis 55, and supporting respective pins 162 perpendicular to the common plane through axis 55 and each defining the pivot of a respective jaw 153.

Each jaw 153 comprises a substantially star-shaped rocker arm in turn comprising a gripping arm 163 extending downwards from pin 162 and designed to contact spray head 7; and two actuating arms 164 and 165, the first of which is substantially aligned with arm 163 and extends upwards from pin 162 to engage elastic device 154, and the second of which extends squarely in relation to arms 163 and 164 towards axis 55, and engages an annular groove 166 formed on the outer surface of a piston 167 supported on arms 165 and fitted in sliding manner inside a cavity 168 of the same section and formed in the end wall of cavity 160.

Piston 167 is defined at the top by a flat surface 169 on which rod 84 acts to open, in use, jaws 153, and is defined at the bottom by a flat surface 170 which, in use, cooperates with spray head 7 to withdraw tubular body 145 inside body 136.

Elastic devices 154 are arranged opposite each other inside respective holes 171 formed in the top of body 157, perpendicular to the common plane through axis 55, and on either side of axis 55. Each elastic device 154 comprises a helical spring 172 compressed between a cup-shaped body 173 screwed inside one end of respective cavity 170 and for adjusting the preload of each spring 172, and a further cup-shaped body 174 cooperating with relative arm 164 for maintaining jaws 153 in the closed position.

Opening and closing of jaws 153 are thus determined by rod 84 moving along axis 55 in relation to body 145; and, more specifically, as shown in FIG. 8, further penetration of rod 84 inside cavity 168 parts arms 165 into the open position.

Before going on to describe the operation of capping unit 1 as a whole, some explanation should first be given of the operation of capping head 82 alongside rotation of respective assembly 69 about axis 13, and a variation in the relative positions of shafts 70 and 83 and rod 84.

Upon drum 65 being rotated about axis 13 by motor 66, engagement of each pinion 67 with fixed ring gear 81 produces a rotation of respective shaft 70 about axis 55 and in relation to respective shaft 83 and rod 84 which are maintained angularly fixed in relation to drum 65 by bush 94. By means of bell 108 and joint 119, each shaft 70 rotates relative ring gear 115 about axis 55, thus rotating gears 131 and hence shafts 127 of gripping device 121 about their axes 129 by means of epicyclic drive 143.

When jaws 125 of gripping device 121 are in the closed position with respective rollers 130 contacting ring nut 6 of cap 5, rotation of shafts 127 and hence of respective rollers 130 about respective axes 129 provides for screwing ring nut 6 on to neck 4 of container 3.

As already stated, jaws 125 are normally maintained open by respective spring-loaded pins **133*a*, and are closed by means of drive 141 upon shaft 83 moving axially downwards in relation to shaft 70 and hence upon cam body 135 moving downwards in relation to tappet rollers 133 controlling jaws 125**.

In connection with the downward movement of shaft 83 in relation to shaft 70, it should be pointed out that, in the event the radial size of ring nut 6 is such as to result in contact pressures over and above a given value, the downward movement of bush 94, which normally results in a similar downward movement of shaft 83, is converted at a given point into an upward movement of shaft 83 in relation to sleeve 93 and in opposition to spring 100 which acts as both a grip damping and grip pressure limiting device.

A further point to note in connection with the downward movement of shaft 83 in relation to shaft 70 is that, when device 119 transmits the drive torque generated by motor 66, rollers 130, regardless of the position of jaws 125, are rotated continuously at a given speed by drives 79 and 143, and that this rotation is transmitted by drive 143 regardless of the angular position of jaws 125 by virtue of the convex longitudinal profile **131*a* of the teeth of gears 131 which mesh permanently with ring gear 115 regardless of the position of respective axes 129 about respective axes 123*c* and in relation to axis 55**.

Jaws 153 of gripping device 122, on the other hand, are normally maintained closed by elastic device 154, and are opened by rod 84 moving axially downwards in relation to shafts 70 and 83. More specifically, rod 84 (FIG. 4) is maintained raised in relation to shaft 83 by spring 101, and spring 150 (FIG. 8) maintains projection 148 contacting shoulder 149, so that, when rod 84 moves down in relation to shaft 83, piston 167 moves down to open jaws 153 in opposition to elastic device 154.

Spring 150 acts as a contact damping device between capping head 82 and container 3, and at the same time provides for compensating displacement of cap 5 in relation to container 3 when ring nut 6 is screwed on.

Operation of capping unit 1 will now be described with special reference to FIG. 6, and as of when a container 3 and respective cap 5 are fed, one over the other, by conveyor 15 to carousel conveyor 12 along respective channels 38 and 39. As they are fed towards conveyor 12, container 3 and respective cap 5 approach station 14 simultaneously with a capping assembly 69 which is located close to position A in FIG. 6 and at the same distance from station 14 as respective container 3 and cap 5. As already stated, assembly 69 is fed towards station 14 by motor 66 rotating drum 65 about axis 13.

Figure 6:
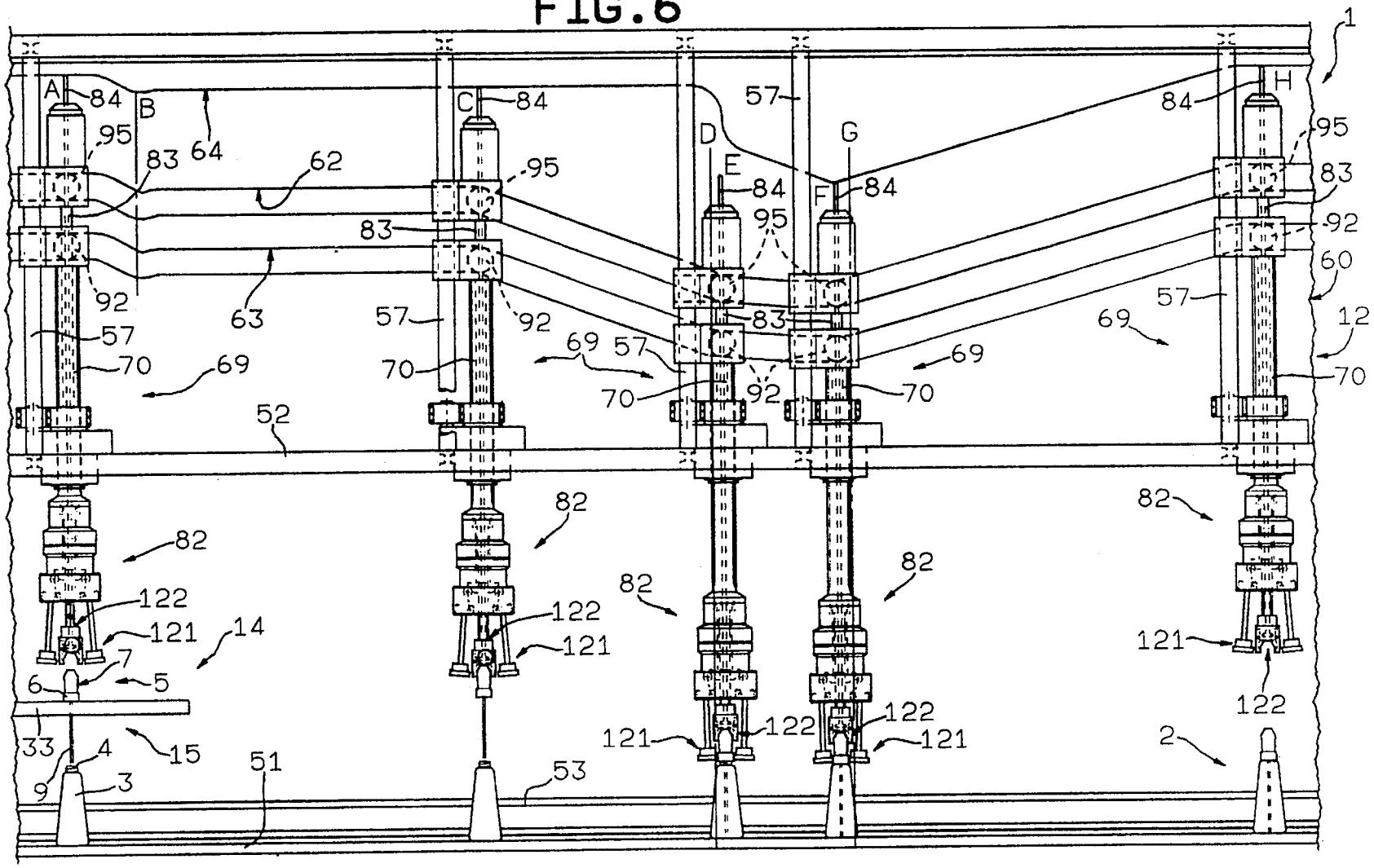
FIG. 6 shows a spread-out side view of the FIG. 3 detail, with parts removed for clarity.

As it approaches position A in FIG. 6, assembly 69 travels along substantially horizontal portions of grooves 62, 63 and shoulder 64. More specifically, and as shown on the left in FIG. 3, said horizontal portions constitute the parts of grooves 62, 63 and shoulder 64 furthest away from flange 52, and (FIG. 6) are separated by such a distance as to maintain shaft 83 in the raised position in relation to shaft 70, corresponding to the open position of gripping device 121, while rod 84 is maintained in the lowered position in relation to shaft 70, corresponding, as already explained, to the open position of gripping device 122.

Between position A and position B at station 14, assembly 69 first travels along equally downward-sloping portions of grooves 62, 63 and shoulder 64; which sloping portions maintain rod 84 and shafts 70, 83 axially fixed in relation to one another, and at the same time move the whole of assembly 69 downwards so that jaws 153 are positioned on either side of spray head 7 of respective cap 5. Close to position B, shoulder 64 slopes downwards slightly less than grooves 62, 63, thus increasing the distance between shoulder 64 and grooves 62, 63, so that, by virtue of the thrust exerted by spring 101, rod 84 is moved into the raised position in relation to shafts 83 and 70, thus closing gripping device 122 about cap 5 at position B. At this point, assembly 69 is raised slightly, while at the same time maintaining rod 84 and shaft 83 axially fixed in relation to each other and to shaft 70, so that cap 5 is gripped by capping assembly 69 at position B, is removed from input conveyor 15, and is fed along the circular path defined by conveyor 12, together with and coaxially with respective container 3 along axis 55.

Between positions B and C, assembly 69 travels along parallel, substantially horizontal portions of grooves 62, 63 and shoulder 64, thus remaining at the same level and with rod 84 and shafts 70, 83 axially fixed in relation to one another.

Between positions C and D, assembly 69 travels along equally downward-sloping portions of grooves 62 and 63, while shoulder 64 remains substantially horizontal. The sloping portions of grooves 62 and 63 maintain shafts 70 and 83 axially fixed in relation to each other, and at the same time move the whole of assembly 69 downwards so that suction tube 9 is inserted inside container 3 and ring nut 6 axially engages the end of neck 4 of container 3. Simultaneously with the downward movement of assembly 69, the horizontal portion of shoulder 64 moves rod 84 away from shoulder 64, so that rod 84 remains axially fixed in relation to shafts 70 and 83, and gripping device 122 remains firmly closed about cap 5.

Between position D and a nearby position E, groove 62 presents a portion with a downward slope equal to that of portion C–D, but greater than the slope of the respective portion of groove 63, while shoulder 64 remains horizontal. Since, as of position D, ring nut 6 rests on container 3 and cannot be lowered further unless rotated, the downward slope of grooves 62 and 63 as of position D provides for further lowering assembly 69 towards container 3, and so moving body 145 upwards along body 136 and in opposition to spring 150. At the same time, the difference in the slope of grooves 62 and 63 as of position D provides for moving shaft 83 axially into the lowered position in relation to shaft 70, corresponding, as already explained, to the closed position of gripping device 121. Gripping device 121 thus moves down, integral with head 82, towards ring nut 6 of cap 5, so as to position jaws 125 on either side of ring nut 6, and is closed at position E by drive 141 to bring rollers 130 into contact with ring nut 6.

Cap 5 is screwed on to container 3 to form bottle 2 along a portion of drum 65 extending between position E and an assembly position F, along which portion the slope of grooves 62 and 63 gradually lessens until it substantially levels off at assembly position F. Nevertheless, to enable capping unit 1 to adapt to containers 3 with necks 4 of different lengths and external threads, the downward movement imparted to assembly 69 by grooves 62 and 63 between positions E and F is faster than the speed with which ring nut 6 is fitted on to neck 4 of container 3 as a result of head 82 being rotated continuously by drives 79 and 143. Subsequent leveling-off of grooves 62 and 63 at position F enables drive 155 to be moved down by spring 150 so as to screw ring nut 6 fully on to neck 4 of container 3 and so complete the assembly of bottle 2 at position F. Upon ring nut 6 being screwed fully on to the thread of neck 4, the resisting torque applied to drive 143 increases sharply, thus opening device 119 and arresting rotation of rollers 130.

In other words, spring 150 acts as an elastic compensating member for compensating between the speed at which head 82 is moved down by the slope of grooves 62 and 63, and the speed at which ring nut 6 is moved down in relation to neck 4 by rollers 130 rotating about respective axes 129.

Between positions E and F, shoulder 64 presents a downward-sloping portion for bringing rod 84 back into contact with shoulder 64 at position F. Close to position F, the downward slope of shoulder 64 is slightly greater than that of grooves 62 and 63, thus shortening the distance between shoulder 64 and grooves 62, 63, so that rod 84 moves into the lowered position in relation to shafts 83, 70, gripping device 122 is opened at position G, and spray head 7 of cap 5 is released by jaws 153.

Along portion F-G, groove 63 presents a substantially horizontal portion, and then slopes upwards until, at the next position H, it is on a level with position A.

Along portion F-G, groove 62 presents a portion rising more steeply than the corresponding portion of groove 63, and continues rising along portion G–H until, at position H, it is on a level with position A.

The difference in the slope of grooves 62 and 63 along portion F–G provides, at position G, for opening gripping device 121, so that rollers 130 release ring nut 6, and the assembled bottle 2 is released by capping assembly 69.

Gripping devices 121 and 122 therefore enable head 82 to positively engage both spray head 7 and ring nut 6 of cap 5, and to transmit rotational movement to ring nut 6 with absolutely no sliding or rolling friction between drives 79, 143 and ring nut 6.

We claim:

1. A capping unit (1) for automatically assembling pump-operated spray cap bottles (2) comprising a container (3) with an externally threaded neck (4), and a cap (5) presenting both a pump-operated spray head (7) and an internally threaded ring nut (6) mounted for rotation on the spray head (7); the capping unit (1) presenting at least one capping assembly (69) comprising a capping head (82); the capping head (82) comprising a first gripping device (122) movable into a closed position to grip a respective said spray head (7), and a second gripping device (121) presenting two jaws (125) movable into a closed position to grip the ring nut (6);

and the capping assembly (69) comprising first actuating means (155, 154) for moving the first gripping device (122) to and from the closed position, second actuating means (141) for moving the second gripping device (121) to and from the closed position, third actuating means (79, 130, 143) for rotating the ring nut (6) in relation to the first gripping device (122), and fourth actuating means (63) for moving the capping head (82) to and from a position wherein said cap (5) is connected to the relative said container (3); characterized in that said second gripping device (121) comprises, for each jaw (125), a gripping roller (130) forming the end portion of the jaw (125); said second actuating means (141) being connected to each jaw (125) for moving it to and from the relative said closed position wherein the relative gripping roller (130) contacts said ring nut (6); and said third actuating means (79, 130, 143) being connected to each said gripping roller (130) to rotate it about a first axis (129), and comprising a drive (143) in turn comprising a ring gear (115) presenting a second axis (55) and rotating about the second axis (55) in relation to the first gripping device (122), and, for each gripping roller (130), a planetary gear (131) coaxial with the respective first axis (129) and integral with the relative gripping roller (130).

2. A unit as claimed in claim 1, characterized in that said drive (143) also comprises a carrier (123) coaxial with and fixed in relation to the second axis (55); each planetary gear (131) being supported by said carrier (123).

3. A unit as claimed in claim 2, characterized in that each said jaw (125) is supported by said carrier (123) so as to rotate, in relation to the carrier (123), about a third axis (123*c*) to and from said closed position; the third axis (123*c*) being perpendicular to the plane defined by the other two axes (55, 129); each planetary gear (131) being movable with the respective jaw (125) about the third axis (123*c*), being barrel-shaped, and presenting teeth in turn presenting a convex longitudinal profile (131*a*) and meshing permanently with the ring gear (115) regardless of the orientation of the respective said first axis (129) about the respective said third axis (123*c*) and in relation to the second axis (55).

4. A unit as claimed in claim 3, characterized in that said convex longitudinal profile (131*a*) is defined by a generating line portion of a spherical ring substantially tangent to the pitch line of said ring gear (115) and with its center along the relative third axis (123*c*).

5. A unit as claimed in claim 1, characterized in that said drive (143) forms part of the capping head (82) which comprises an outer tubular element (109) coaxial with the second axis (55); said third actuating means (79, 130, 143) comprising drive means (70, 79, 108) for rotating the tubular element (109) about the second axis (55); and said ring gear (115) being formed on said tubular element (109).

6. A unit as claimed in claim 5, characterized in that said drive means (70, 79, 108) comprise a further tubular element (108) coaxial with the second axis (55); torque generating means (79) connected to said further tubular element (108) for rotating it about the second axis (55); and torque limiting means (119) for angularly connecting said tubular elements (108, 109).

7. A unit as claimed in claim 3, characterized in that each said jaw (125) comprises a rocker arm (127) in turn comprising an intermediate box (126) pivoting on said carrier (123) so as to rotate about the relative said third axis (123*c*); a first arm (127) defined by a shaft (127) coaxial with the relative first axis (129) and fitted with the relative said gripping roller (130), the shaft (127) comprising an end portion (127*a*) extending through and connected in rotary manner to the box (126); and a second arm (132) extending from said box on the opposite side of said relative third axis (123*c*) in relation to the first arm (127).

8. A unit as claimed in claim 7, characterized in that said second actuating means (141) comprise a cam body (135) interposed between the second arms (132) of said jaws (125); tappet means (133) being fitted to each second arm (132); elastic means (154) being fitted to each jaw (125) for maintaining the relative tappet means (133) contacting said cam body (135); and thrust means (62) being provided for moving the cam body (135) between said second arms (132), and rotating the second arms (132) in opposite directions about the relative third axes (123*c*).

9. A unit as claimed in claim 1, characterized in that it also comprises a carousel conveyor (12) rotating about a fourth axis (13) parallel to the second axis (55), and in turn comprising a central drum (65) presenting at least one seat (54) for supporting and guiding a respective said container (3) about the fourth axis (13); said capping assembly (69) being supported by the drum (65) coaxially with said seat (54) so as to rotate with the drum (65) about the fourth axis (13).

* * * * *